US009982402B2

(12) United States Patent
Maeyama et al.

(10) Patent No.: US 9,982,402 B2
(45) Date of Patent: May 29, 2018

(54) PAVING CONSTRUCTION METHOD, PAVEMENT STRUCTURE, AND LONGITUDINAL GROOVE FORMING INSTRUMENT FOR PAVEMENT

(71) Applicant: GAEART CO., LTD, Tokyo (JP)

(72) Inventors: Toshihiko Maeyama, Tokyo (JP); Masanobu Sadayasu, Tokyo (JP); Shinji Oba, Tokyo (JP); Kazuyuki Saito, Tokyo (JP); Katsuji Suzuki, Tokyo (JP)

(73) Assignee: GAEART CO., LTD., Tokyo (JP)

( * ) Notice: Subject to any disclaimer, the term of this patent is extended or adjusted under 35 U.S.C. 154(b) by 0 days. days.

(21) Appl. No.: 15/325,688

(22) PCT Filed: Mar. 5, 2015

(86) PCT No.: PCT/JP2015/056551
§ 371 (c)(1),
(2) Date: Jan. 11, 2017

(87) PCT Pub. No.: WO2016/031271
PCT Pub. Date: Mar. 3, 2016

(65) Prior Publication Data

US 2017/0159250 A1 Jun. 8, 2017

(30) Foreign Application Priority Data

Aug. 25, 2014 (JP) ..... 2014-170839

(51) Int. Cl.
*E01C 23/02* (2006.01)
*E01C 7/35* (2006.01)
(Continued)

(52) U.S. Cl.
CPC ..... *E01C 23/02* (2013.01); *E01C 7/35* (2013.01); *E01C 11/24* (2013.01); *E01C 19/43* (2013.01); *E01C 19/48* (2013.01)

(58) Field of Classification Search
CPC . E01C 23/02; E01C 7/35; E01C 11/24; E01C 19/43; E01C 19/48
(Continued)

(56) References Cited

U.S. PATENT DOCUMENTS 2,473,961 A * 6/1949 Mandt ..... E01C 19/4873 118/103
3,516,340 A * 6/1970 Perkins ..... E01C 19/43 404/75
(Continued)

FOREIGN PATENT DOCUMENTS

JP S50-158419 U 12/1975
JP 2001-355203 A 12/2001
(Continued)

OTHER PUBLICATIONS

ISA/JP, International Search Report dated Apr. 28, 2015 in International Application No. PCT/JP2015/056551, total 5 pages with translation.
(Continued)

*Primary Examiner* — Raymond W Addie
(74) *Attorney, Agent, or Firm* — Masuvalley & Partners

(57) ABSTRACT

A longitudinal groove forming instrument 11 is provided on a base plate bottom face of a screed 7, 8. The longitudinal groove forming instrument 11 comprises a plurality of beam members 12. The beam members 12 are disposed in parallel with the direction of travel of the screed as the axial direction. A longitudinal groove 20 is formed by the beam members 12 pressing into a leveled face when leveling a
(Continued)

pavement face and moving in the direction of travel for leveling while the beam members are being pressed down.

6 Claims, 9 Drawing Sheets

(51) Int. Cl.
*E01C 11/24* (2006.01)
*E01C 19/43* (2006.01)
*E01C 19/48* (2006.01)

(58) Field of Classification Search
USPC ..... 404/75, 89, 117, 118
See application file for complete search history.

(56) References Cited

U.S. PATENT DOCUMENTS 3,775,018 A * 11/1973 Barton ..... E01C 19/43 299/36.1
4,070,128 A * 1/1978 Garrison ..... E01C 19/43 15/144.4
4,743,140 A * 5/1988 Maletic ..... E01C 19/43 404/89
5,073,062 A * 12/1991 Leone ..... B28B 11/0863 404/75
5,249,886 A * 10/1993 Huerta, Jr. ..... E01C 23/025 15/144.1
2005/0036838 A1* 2/2005 Sovik ..... E01C 19/42 404/118

FOREIGN PATENT DOCUMENTS

JP 2002-69924 A 3/2002
JP 2002-206203 A 7/2002
JP 2011-140830 A 7/2011
JP 2012-219604 A 11/2012
JP 2013-87586 A 5/2013
JP 2013-217055 A 10/2013

OTHER PUBLICATIONS

IPEA/JP, International Preliminary Report on Patentability dated Jul. 10, 2015 in International Application No. PCT/JP2015/056551, Total 6 pages with translation.

* cited by examiner

PAVING CONSTRUCTION METHOD, PAVEMENT STRUCTURE, AND LONGITUDINAL GROOVE FORMING INSTRUMENT FOR PAVEMENT

RELATED APPLICATIONS

This application is a U.S. National Phase application under 35 U.S.C. § 371 of International Patent Application No. PCT/JP2015/056551 filed Mar. 5, 2015, which claims priority to Japanese Patent Application No. JP2014-170839 filed Aug. 25, 2014, which are hereby expressly incorporated by reference in their entirety for all purposes.

TECHNICAL FIELD

The present invention relates to a paving technology. More specifically, the present invention relates to pavement having longitudinal grooves.

BACKGROUND ART

In the general grooving pavement, grooves having a width of 6 to 9 mm and a depth of 4 to 6 mm are formed on a pavement face thereof at intervals of 40 to 60 mm. The grooving pavement are classified into a longitudinal type (longitudinal grooves) and a transverse type (transverse grooves). In the longitudinal type, grooves are formed in a vehicle travel direction. In the transverse type, grooves are formed transversely to a vehicle travel direction.

In most cases, the longitudinal type grooving pavement is employed for a road surface of a winding road which requires a large skid resistance value specifically in a direction transverse to a vehicle travel direction. The transverse type grooving pavement is extremely effective specifically in shortening a braking distance of a vehicle and thus is employed for a road surface immediately before coming into an intersection or a sloping road. Further, the transverse type grooving pavement is capable of causing the driver to be informed of a sign, falling asleep at the wheel, overspeed, etc. by means of sound and vibration generated while traveling a car.

In addition to the increased skid resistance, the grooving pavement facilitates drainage and speedy drying of a road surface, thereby preventing slip of tires in the rain. Specifically, the grooving pavement produces a hydroplaning suppression effect.

Further, in cold regions, the grooving pavement produces an antifreezing effect, a snow accumulation prevention effect, and a snow melting effect in addition to the remarkable slip prevention effect. In the grooving pavement, a road surface is formed into a rough surface, which increases the surface area as well as forms groove spaces. This contributes to heat accumulation. As a result, a temperature of the road surface becomes higher in comparison with a temperature of the general pavement. Further, in a case where a chemical agent such as a calcium chloride, etc. is sprayed as an antifreezing agent, the snow melting effect lasts because the chemical agent partially remains in grooves even after vehicles pass over the road. Still further, even in a case where water freezes on the road surface to be Black Eisbahn, a Black Eisbahn wear accelerating effect is produced owing to a contact with tires of passing vehicles.

CITATION LIST

Patent Literature

[PATENT LITERATURE 1] JP 2001-355203
[PATENT LITERATURE 2] JP 2002-206203

SUMMARY OF INVENTION

Technical Problem

In the grooving construction method in the field of asphalt pavement, cutting by means of a specialized machine is mainly employed. Initially, pavement is constructed according to a general pavement construction method, and a cutting step is subsequently performed. This raises problems of increased construction cost and elongated construction period in comparison with the general pavement construction method.

Further, the cutting step requires a dust disposal step. This makes a problem of increased construction cost and elongated construction period more serious.

There is a tine grooving construction method in one of the grooving construction methods in the field of concrete pavement. In the method, grooves are formed on a pavement face in a road crossing direction at the time of concrete paving by using a piano wire, etc. The tine grooving construction method is suitable for forming transverse grooves but is not suitable for forming longitudinal grooves. Further, the tine grooving construction method does not produce a satisfactory drainage effect.

The present invention was made to solve the above described problems. A purpose of the present invention is to provide a longitudinal groove forming technology that is easy to execute.

Solution to Problem

The present invention for solving the above described problems is directed to a paving construction method. In the method, in leveling a pavement face, longitudinal groove forming members are pressed into the leveled face and, subsequently, moved in a direction of travel for leveling. Accordingly, the longitudinal grooves are formed.

The present invention is directed to a paving construction method using a longitudinal groove forming instrument for pavement that is disposed on a bottom face of a screed device and includes a plurality of beam members disposed in parallel with a direction of travel of the screed device as an axis direction. In the method, longitudinal grooves are formed by the beam members being pressed into a leveled face when a pavement face is leveled by the screed device and being moved in a direction of travel of the screed device following the screed device while the beam members are being pressed into the leveled face.

In the present invention, the longitudinal grooves are formed at the time of leveling a pavement face. This makes it easier to form longitudinal grooves in comparison with the conventional art.

In the above described invention, preferably, the screed device has a vibration function for applying vibrations while leveling the pavement face.

With the structure, aggregate is pressed into wall surfaces of longitudinal grooves. This can decrease possible scattering of aggregate and improve durability.

In the above described invention, preferably, the pavement is asphalt pavement, and the screed device is provided on an asphalt finisher.

The present invention is applicable to asphalt pavement.

In the above described invention, further preferably, the asphalt finisher includes a tamper device provided with protruding members disposed on a bottom face thereof. The protruding members are pressed into the leveled face to form concave portions, and the beam members are pressed into the leveled face at positions corresponding to the concave portions.

According to the paving construction method, longitudinal grooves having curve parts can be formed. Further, construction accuracy enhances.

In the above described invention, further preferably, the asphalt pavement includes a lower layer having a waterproof function and an upper layer having a drainage function, and the longitudinal grooves are formed on the upper layer.

According to the paving construction method, the asphalt pavement having both of a waterproof function and a drainage function is further equipped with the longitudinal grooves. This remarkably enhances the drainage function.

In the above described invention, preferably, the pavement is concrete pavement, and the screed device is a blitzscreed.

In the above described invention, preferably, the pavement is concrete pavement, and the screed device is a mold provided on a slipformpaver.

The present invention is applicable to concrete pavement.

The present invention is directed to a pavement structure equipped with longitudinal grooves formed by the above described paving construction method.

The present invention is directed to a pavement structure equipped with longitudinal grooves having curve parts repeating in a road longitudinal direction.

With the curve parts, durability improves, a grip force improves, and effects produced by longitudinal grooves in cold regions improves.

The present invention for solving the above described problems is directed to a longitudinal groove forming instrument for pavement that is disposed on a bottom face of a screed device and includes a plurality of beam members disposed in parallel with a direction of travel of the screed device as an axis direction.

With the use of the longitudinal groove forming instrument for pavement according to the present invention, the longitudinal grooves can be formed with ease.

Advantageous Effect of Invention

The present invention makes it easier to form longitudinal grooves in comparison with the conventional art. As a result, construction cost and construction period can be decreased.

DESCRIPTION OF EMBODIMENTS

First Embodiment

~Structure~

A basic structure of an asphalt finisher to which the present embodiment is applied will be described below.

Figure 1:
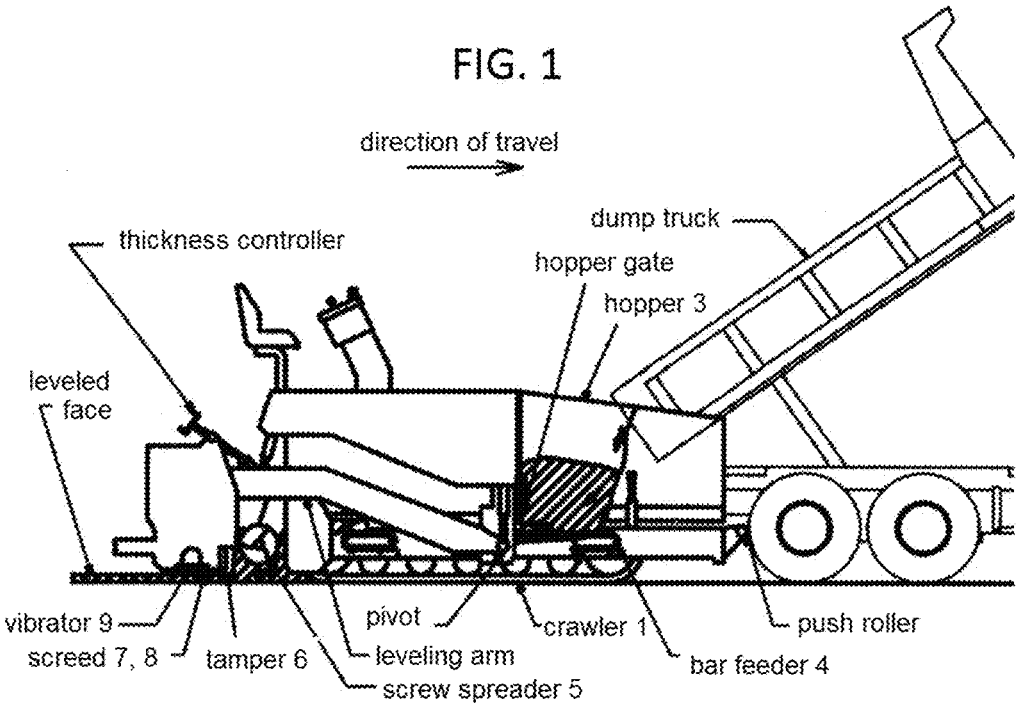
FIG. 1 is a schematic block diagram illustrating an asphalt finisher.

FIG. 1 is a schematic block diagram illustrating an asphalt finisher. The asphalt finisher is composed of various constitution devices such as a crawler 1 for traveling, a driver's seat 2 for operator's driving operation, a hopper 3 that is positioned in front of the driver's seat 2 and into which asphalt mixture is charged thereinto from a dump truck, a bar feeder 4 for conveying the charged asphalt mixture rearwardly, a screw spreader 5 that is positioned behind the driver's seat 2 in order to spread the asphalt mixture uniformly over a width of pavement, a tamper 6 that is positioned behind the screw spreader 5 in order to compact the spread asphalt mixture, a main screed 7 with expansion screeds 8 for spreading and leveling the asphalt mixture, etc. Wheels may be employed instead of the crawler.

Figure 2:
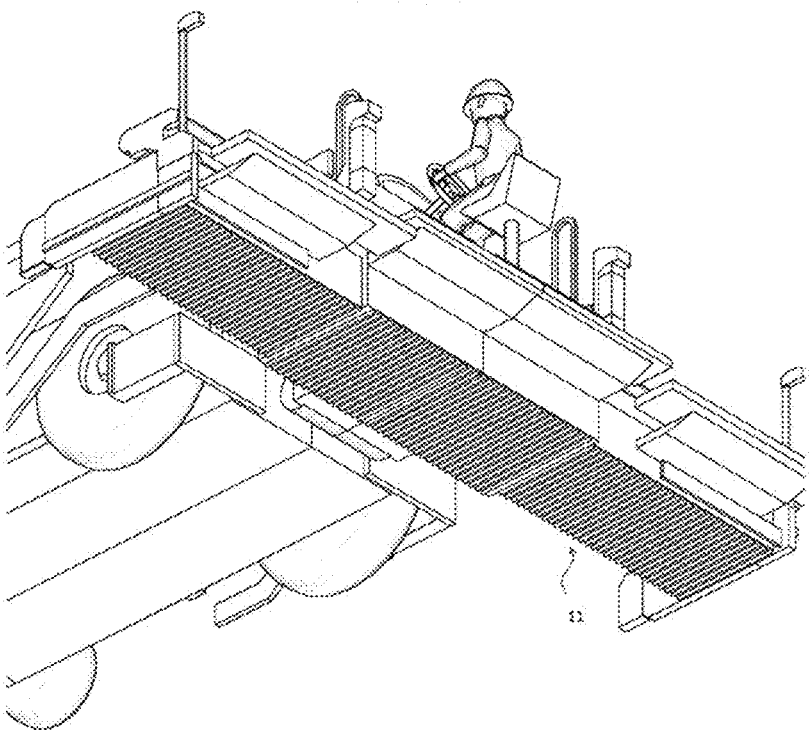
FIG. 2 illustrates a screed and a longitudinal groove forming instrument (first embodiment).

Two expansion screeds 8 are disposed on both sides of the main screed 7 (see, FIG. 2). The expansion screeds 8 expands in a right and left direction (transverse to a direction of travel). Therefore, the spreading and leveling of any width can be performed.

A vibrator (oscillation mechanism) 9 is provided on the screeds 7, 8. The vibrator 9 works, together with the tamper 6, to compact the asphalt mixture.

Figure 3:
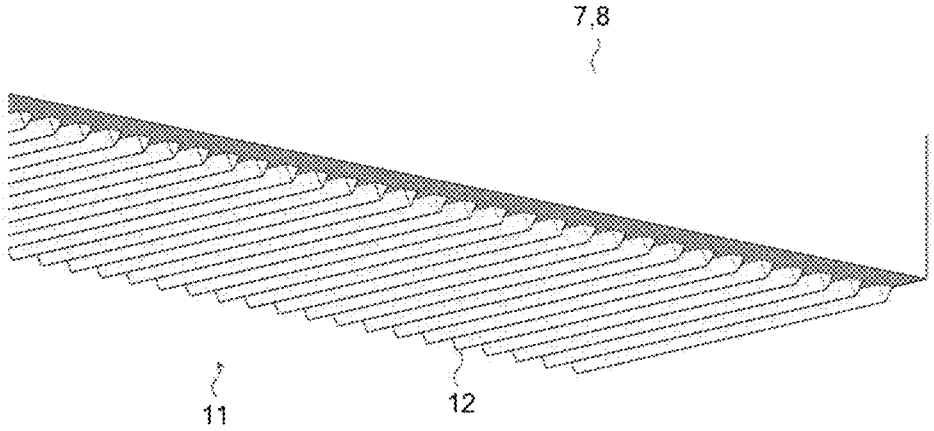
FIG. 3 illustrates the longitudinal groove forming instrument in detail.

As a featured structure of the present embodiment, a bottom face of a base plate of the screeds 7, 8 is provided with a longitudinal groove forming instrument 11 (see, FIG. 2). FIG. 3 illustrates the longitudinal groove forming instrument 11 in detail.

The longitudinal groove forming instrument 11 includes a plurality of beam members 12. The beam members 12 are disposed in parallel with a direction of travel of the screeds as an axial direction.

FIG. 3 illustrates the beam members having an inverted triangle shaped cross section as a preferable example. A circular shape, a semi-circular shape, a plane shape, an inverted trapezoidal shape, etc. can also be applied.

Figure 3A:
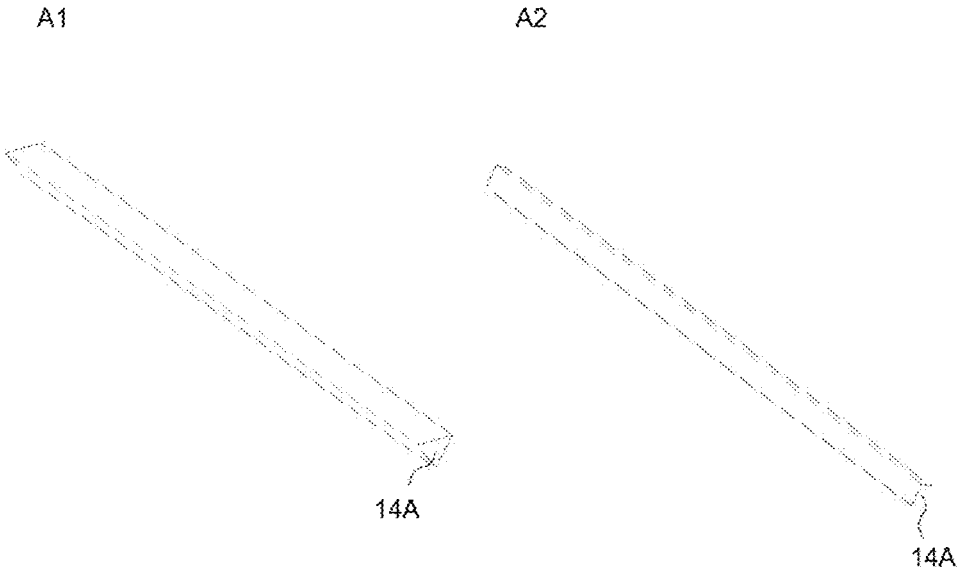
FIG. 3A illustrates beam member ends.
Figure 3B:
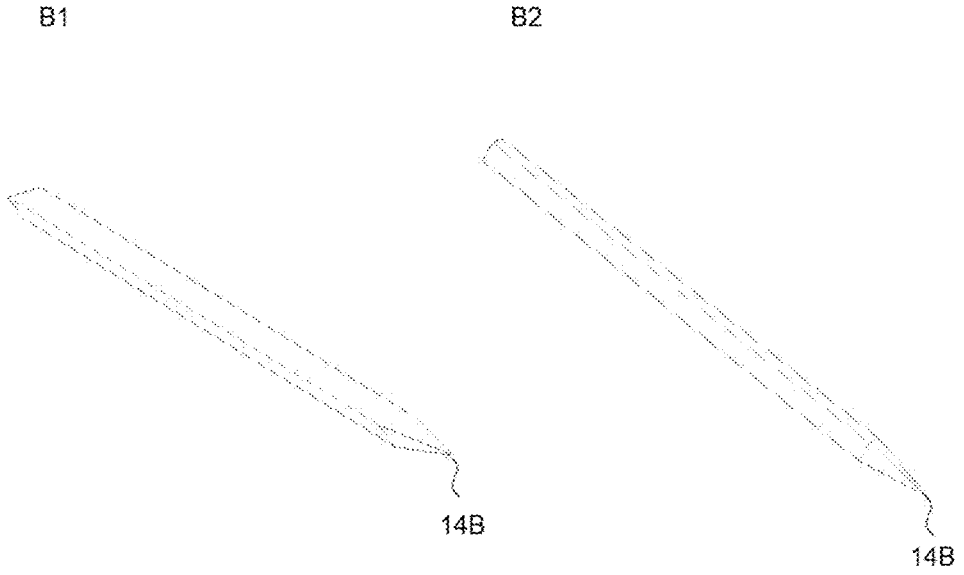
FIG. 3B illustrates beam member ends.
Figure 3C:
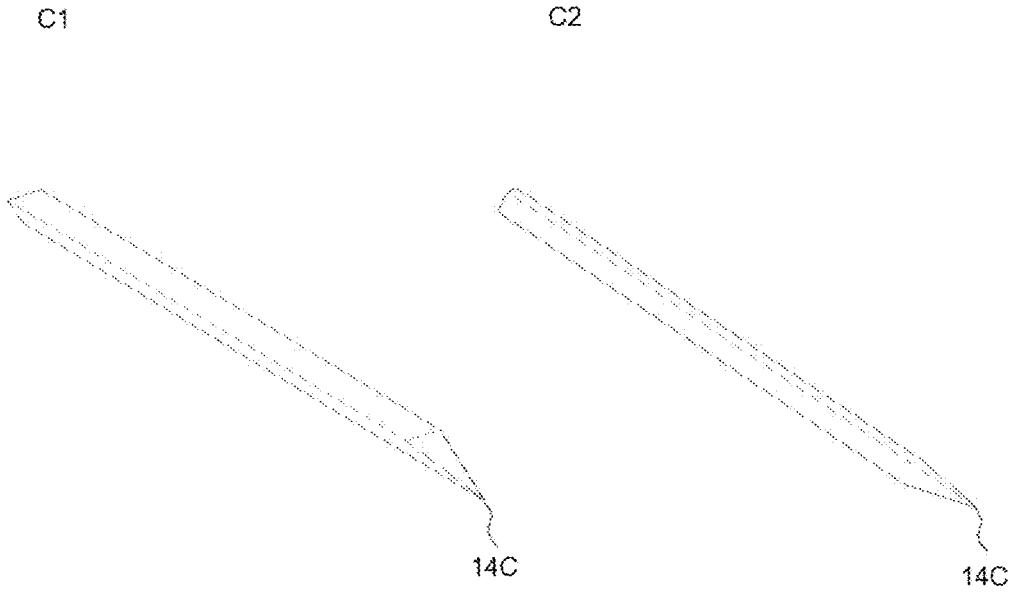
FIG. 3C illustrates beam member ends.
Figure 3D:
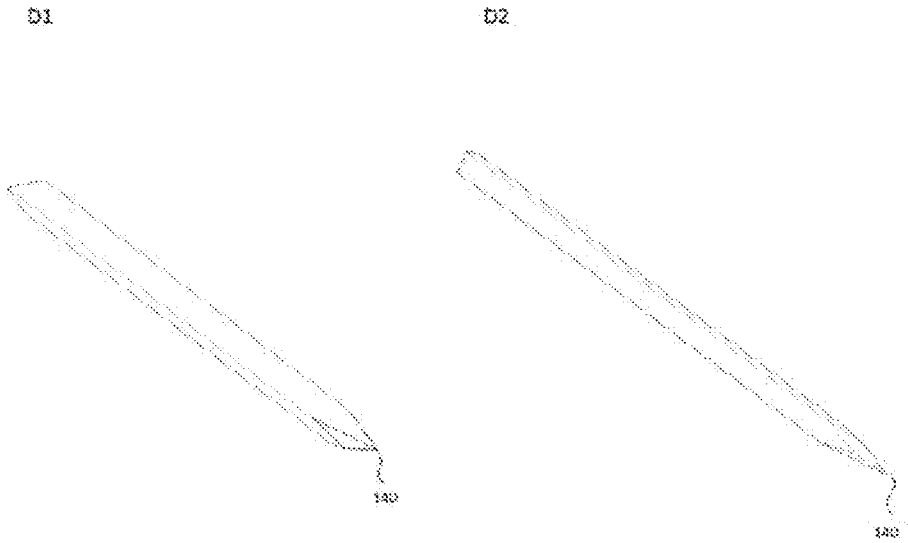
FIG. 3D illustrates beam member ends.

A beam member end 14 may have a flat shape 14A (see, FIG. 3A). Alternatively, if the beam member end 14 is processed to be formed into a spindle shape (see, FIG. 3B to FIG. 3D), it is much better when considering decrease of asphalt separation resistance. Each of FIG. 3A1, FIG. 3B1, FIG. 3C1, and FIG. 3D1 is a perspective view illustrating a beam member end in a state when it is mounted. Each of FIG. 3A2, FIG. 3B2, FIG. 3C2, and FIG. 3D2 is a perspective view illustrating the beam member end in an upside-down state. In the beam member end 14B, a pressure surface side is cut obliquely to form the end into a trigonal pyramid shape. The beam member end 14B is formed into a shape similar to a bow of a ship. In the beam member end 14C, a mount surface side is cut obliquely to form the end into a trigonal pyramid shape. The beam member end 14C is formed into a shape similar to a head of a high-speed railway vehicle. In the beam member end 14D, a pressure surface side and a mount surface side are cut obliquely to form the end into a square pyramid shape. The beam member end 14D is formed into a shape similar to a spear.

In the beam members 12, a width of the cross section is 2 mm to 40 mm, and a height of the cross section is 2 mm to 40 mm. In the beam members 12, a preferable width of the cross section is 5 mm to 20 mm, and a preferable height of the cross section is 5 mm to 20 mm. A length of the beam members 12 is 50 to 100% of a length of the bottom face of the screed. When the beam members 12 are pressed into an asphalt leveled face, the beam members 12 may be bent due to resistance of the asphalt. Therefore, the beam members 12 that are too long are not preferred.

The beam members 12 are arranged at intervals of 10 mm to 200 mm from a center of one beam member to a center of the next beam member. Preferably, the beam members 12 are arranged at intervals of 20 mm to 100 mm from a center of one beam member to a center of the next beam member.

The beam members 12 may be welded to the bottom face of the base plate of the screeds 7, 8 or may be mechanically joined thereto. For example, screw type beam members 12 are readily exchangeable and a cross sectional shape and a size of the beam members can be selected as required.

~Construction~

Figure 4:
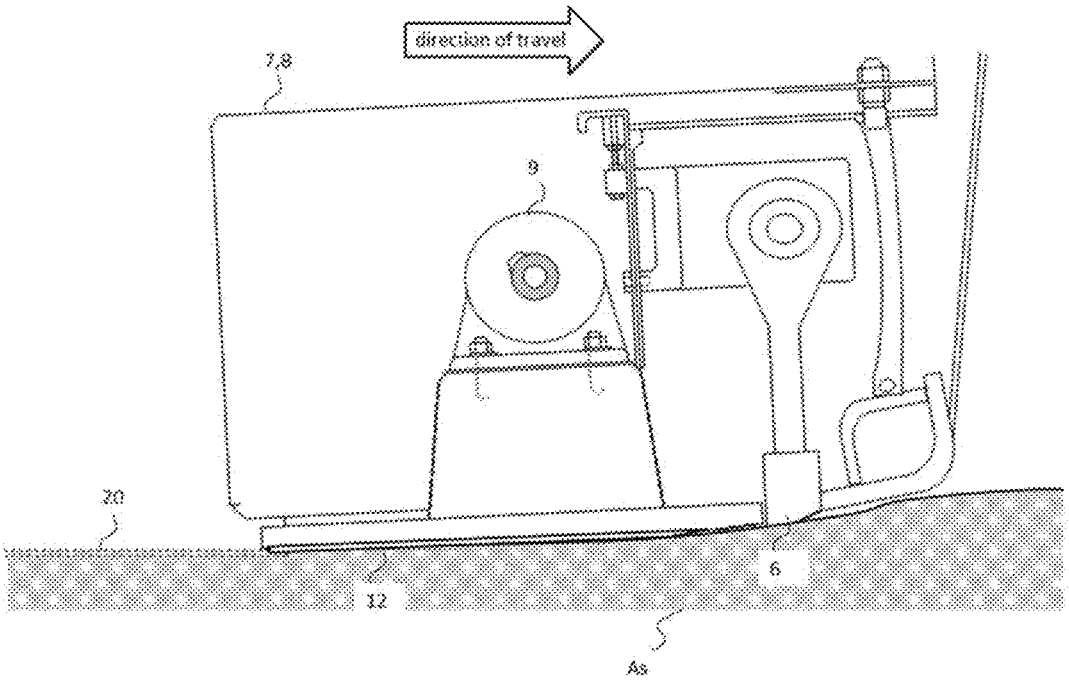
FIG. 4 schematically illustrates an operation (side view).
Figure 5:
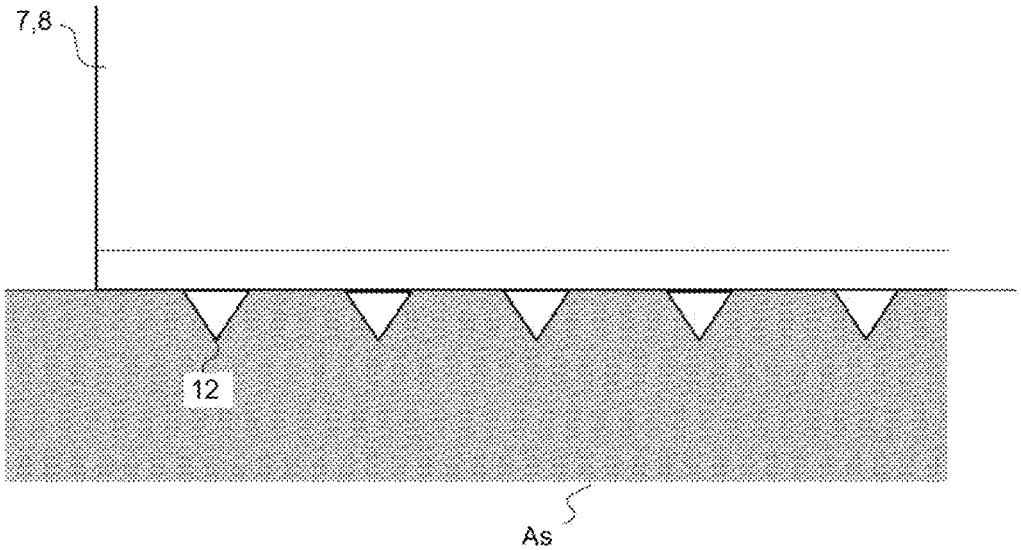
FIG. 5 schematically illustrates an operation (elevation view).
Figure 6:
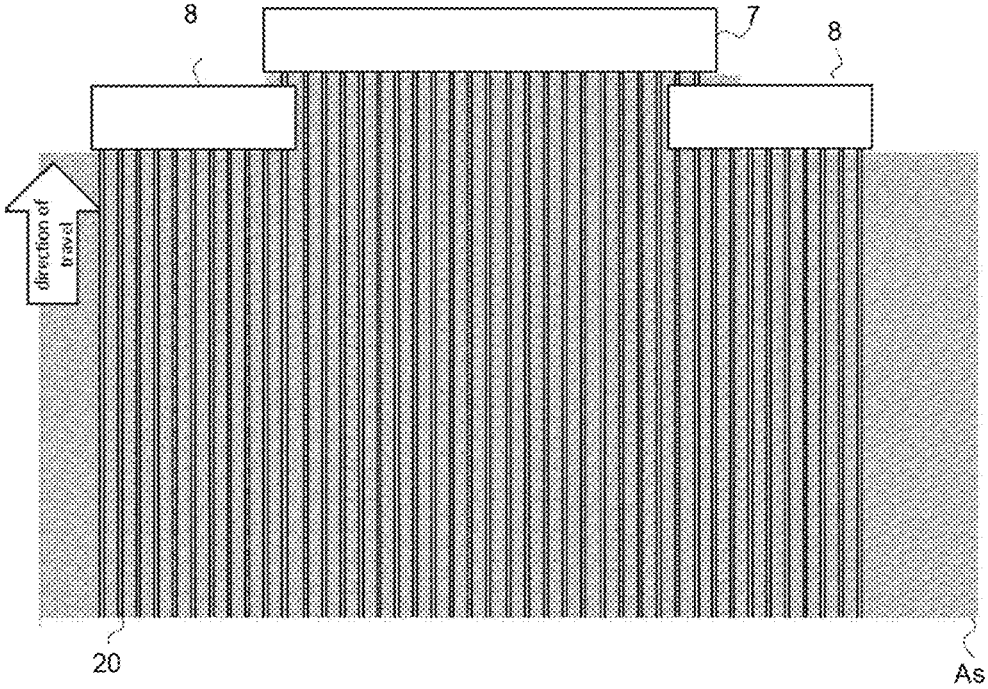
FIG. 6 schematically illustrates an operation (plain view).

A paving construction method of the present embodiment will be described below. FIG. 4 is a side surface view illustrating a state of operation. FIG. 5 is an elevation view illustrating a state of operation. FIG. 6 is a plain view illustrating a state of operation.

Initially, a general paving construction method will be described below.

An asphalt mixture is manufactured at an asphalt mixture factory, transferred to a construction site by a dump truck, and charged into the hopper 3 from the dump truck. The asphalt mixture temporarily stored in the hopper 3 is conveyed by a bar feeder 4, spread by the screw spreader 5, and expanded and leveled by the main screed 7 and the expansion screeds 8.

The asphalt finisher with a crawler 1 (or wheel) moves slowly at a constant speed in a road longitudinal direction while expanding and leveling the asphalt mixture in order to cause a pavement to keep its flatness.

At the time, a spreading operation and a leveling operation are continuously repeated. For example, the spreading operation is performed in an N area and, subsequently, the spreading operation is performed in an N+1 area next to (continuous to) the N area. Simultaneously with the spreading operation in the N+1 area, the leveling operation is performed in the N area. The operations are repeated not discretely but continuously.

After completing the spreading operation and leveling operation of the asphalt mixture, an asphalt pavement face is compacted via rolling compaction by using a roller.

As a featured operation of the present embodiment, the beam members 12 are pressed into the leveled face for leveling the pavement face and moved in a direction of travel for leveling while the beam members are being pressed down, thereby forming longitudinal grooves 20.

The beam members 12 are provided on a bottom face of the base plate of the screeds 7, 8. The beam members 12 are pressed into the leveled face by being applied with a pressing force from the screeds 7, 8 by their own weights (see, FIG. 4 and FIG. 5).

As the asphalt finisher goes ahead, the beam members 12 follow while keeping the state of being pressed into the leveled face.

At the time, in order to reduce following resistance, such a tilt angle that a side of the direction in which the screed is traveling is slightly upwardly inclined may be taken (see, FIG. 4).

The longitudinal grooves 20 are formed according to tracks made by the travel of the beam members 12.

Vibration of the vibrator 9 is transferred to the beam members 12, and the aggregate positioned corresponding to the longitudinal grooves 20 is moved to both walls of the longitudinal grooves 20.

A width of the cross section of the longitudinal grooves 20 corresponds to a width of the cross section of the beam members 12, and a depth of the longitudinal grooves 20 corresponds to a height of the cross section of the beam members 12. In a case where a tilt angle is taken, the depth varies slightly.

A length of the longitudinal grooves 20 extends according to a travel distance of the beam members 12. A distance between centers of the neighboring longitudinal grooves 20 corresponds to a distance between centers of the neighboring beam members 12.

Incidentally, it has been checked in a field experiment that the rolling compaction after the formation of the longitudinal grooves would not make any adverse effect on the structure of the longitudinal grooves 20.

Further, a width of a cross section of a mountain peak portion formed by the neighboring longitudinal grooves (=a distance between longitudinal grooves—a width of the cross section of the longitudinal grooves) is preferably equal to or more than the maximum aggregate dimension of the asphalt aggregate. When a relatively large aggregate is included in a portion formed into the mountain peak portion, a shape stability of the longitudinal grooves to the rolling compaction improves. More specifically, because the aggregate serves to support a load from the rolling compaction, the mountain peak portion is hardly crushed. As a result, a shape of longitudinal grooves can be maintained.

~Effect~

An effect of the present embodiment will be described in comparison with the conventional art.

Conventionally, in the cutting method which is a main stream of the field, pavement is constructed according to a general pavement construction method. Then, the pavement is subjected to a cutting step. Therefore, a dedicated cutting machine is required in this step. This raises problems of requiring more construction cost and a longer construction period than the pavement constructed by the general pavement construction method. In addition, the cutting step requires a dust disposal step. This makes the problems of the construction cost and the construction period more serious.

To solve the above described problems, the longitudinal grooves 20 are formed simultaneously with the spreading and leveling of (more specifically, at the time of leveling) the asphalt mixture in the present embodiment. Therefore, it becomes easier to form the longitudinal grooves in comparison with the conventional art. In other words, a construction period can be shortened because an excessive step is not needed. Further, the longitudinal groove forming instrument 11 has a simple structure and is driven following the asphalt finisher. This contributes to reduction of construction cost.

The cutting method as the conventional technology cuts also the aggregate within the asphalt, which causes a portion of the aggregate to be exposed to a wall surface of a longitudinal groove. This may cause scattering of aggregate. As a result, a problem of durability is raised.

To the contrary, in the present embodiment, because of the vibration and the pressing force of the beam members 12, the aggregate corresponding to the longitudinal grooves 20 is moved to be pressed into the both walls of the longitudinal grooves 20. As a result, the aggregate would not be exposed and thus a possible scattering of aggregate is minimized. This enhances durability.

Further, because the beam member end 14 having a flat shape (see, FIG. 3A) is processed to be formed into to a spindle shape (see, FIG. 3B to FIG. 3D), asphalt separation resistance decreases. As a result, shifting of the beam members 12 is suppressed, thereby enabling more accurate construction. Still further, because side surfaces of the spindle shape are gradually pressed into an asphalt mixture, the asphalt mixture is compacted for sure. This ensures formation of longitudinal grooves having more durability.

Second Embodiment

~Structure~

Figure 7:
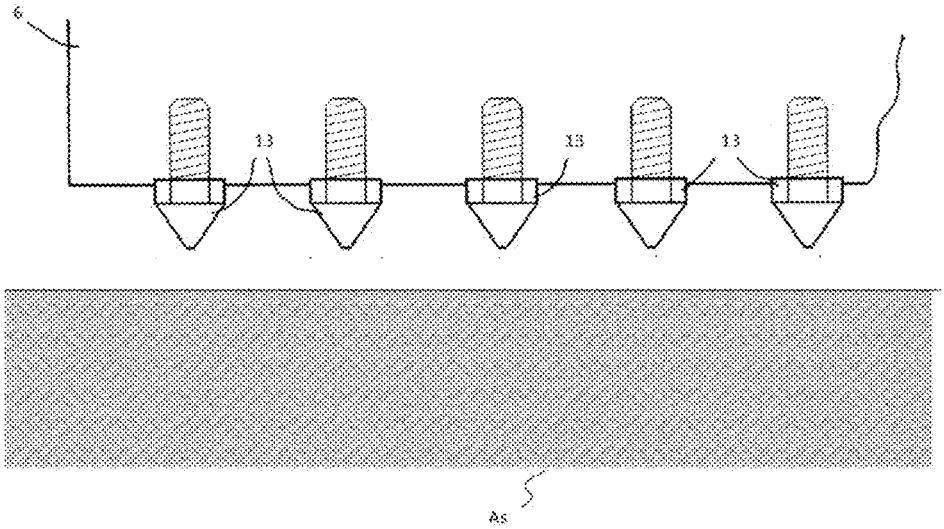
FIG. 7 is a schematic block diagram illustrating an additional structure (second embodiment).

A featured structure of a second embodiment will be described below. In the second embodiment, the following featured structure is added to the first embodiment. FIG. 7 is a schematic block diagram illustrating the second embodiment.

A bottom face of the tamper 6 (see, FIG. 1) of the asphalt finisher is provided with a plurality of substantially conical shaped protruding portions in a direction perpendicular to the direction of travel of the asphalt finisher. The protruding portions are, for example, rivets 13 made of iron.

A diameter of the rivets 13 at its base portion having a cylindrical shape is 2 mm to 40 mm, preferably, 5 mm to 20 mm. It is more preferable that the diameter is larger than the width of the cross section of the beam members 12 (will be described below). The rivets 13 have a height of 2 mm to 4 mm, preferably, 5 mm to 20 mm. It is more preferable that the height is equivalent to the height of the cross section of the beam members 12.

A distance between centers of the neighboring rivets 13 is 10 mm to 200 mm, which corresponds to a distance between centers of the neighboring beam members 12. Further, center positions of the rivets 13 correspond to center positions of the beam members 12.

The rivets 13 may be welded on the bottom face of the tamper 6 or may be mechanically joined thereto. For example, a screw type rivets 13 are readily exchangeable and a size of the rivets can be selected as required.

~Construction~

A paving construction method of the present embodiment will be described below. A basic operation is identical to that of the first embodiment.

The tamper 6 generates vertical vibrations and thereby compacts the asphalt mixture via its bottom plate. The rivets 13 are pressed into the leveled face every up and down movement of the tamper 6, and thereby rivet holes (concave portions) 31 corresponding to the rivets 13 are formed.

Meanwhile, the asphalt finisher travels slowly at a constant speed. As a result, formation of the rivet holes 31 is repeated at regular intervals in the direction of travel over the pavement face.

The screeds, 7, 8 having the beam members 12 are provided behind the temper 6 having the rivets 13. Therefore, subsequent to the formation of the rivet holes 31, the beam members 12 move to positions corresponding to positions of the rivet holes 31.

Accordingly, rivet hole rows made by the rivets 13 and tracks of the beam members 12 are combined to form the longitudinal grooves 30.

Figure 8:
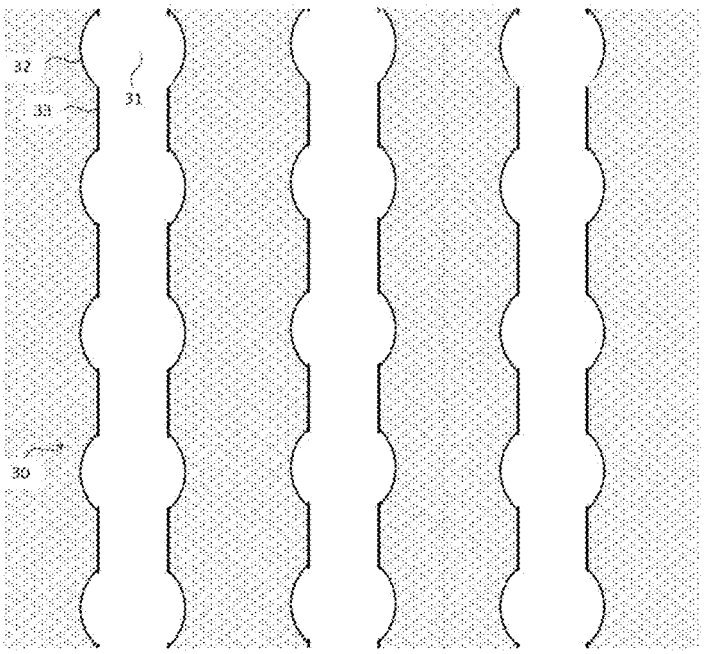
FIG. 8 illustrates a pavement structure.

FIG. 8 illustrates an example of a pavement structure having the longitudinal grooves 30. Both wall surfaces of the longitudinal grooves 30 have curve parts 32 and straight parts 33. The curve parts 32 and the straight parts 33 are repeated in a road longitudinal direction. More specifically, parts of circumferences of the rivet holes 31 are the curve parts 32, and parts of the tracks of the bean members 12 are the straight parts 33.

Figure 9:
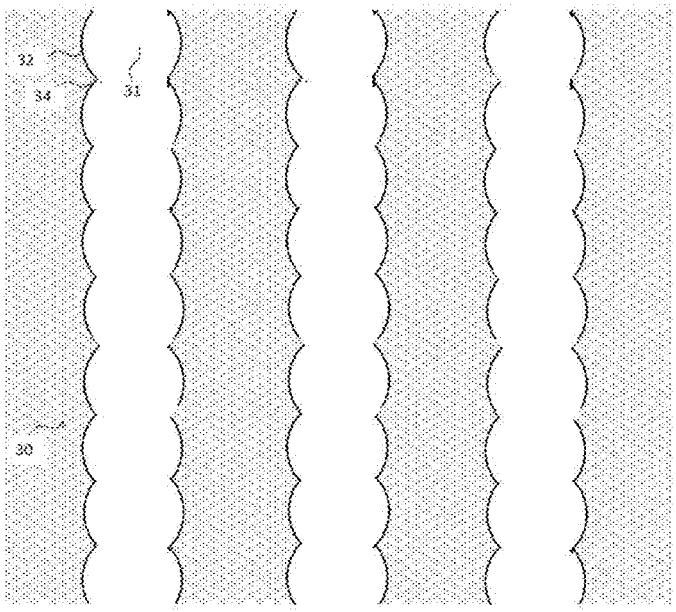
FIG. 9 illustrates a pavement structure (modification).

FIG. 9 is another example of the pavement structure. As the vibration frequency of the tamper 6 becomes larger, a distance between the neighboring rivet holes 31 becomes shorter. This makes the neighboring rivet holes 31 partially overlap each other. The both wall surfaces of the longitudinal grooves 30 have curve parts 32 and beak parts 34. The curve parts 32 and the beak parts 34 are repeated in the road longitudinal direction. The beak parts 34 are formed between the neighboring curve parts 32.

~Effect~

An effect of the second embodiment will be described below in comparison with the first embodiment.

Because the rivet holes 31 are formed at the corresponding positions before the travel of the beam members 12, insertion resistance of the beam members 12 and the following resistance decrease largely. As a result, shifting of the beam members 12 is suppressed, resulting in realizing more precise construction.

Because the longitudinal grooves 30 have the curve parts 32, surface areas of the side surfaces thereof increase. As a result, stress received when a load effects on the longitudinal grooves 30 is dispersed. This enhances durability.

Because the longitudinal grooves 30 have the curve parts 32, surface areas of the side surfaces thereof increase. As a result, a movable range of the aggregate corresponding to the longitudinal grooves 30 is widened. This further decreases a risk of scattering of aggregate, thereby enhancing durability.

Because the longitudinal grooves 30 have the curve parts 32, a contact area with tires during traveling increases. This increases a grip force.

More improvement of effect produced by the longitudinal grooves 30 can be expected in cold regions.

Because the longitudinal grooves 30 have the curve parts 32, a contact area with tires during traveling increases. This improves the Black Eisbahn wear accelerating effect.

The longitudinal grooves 30 have the curve parts 32. The curve parts 32 works as obstacles for preventing the anti-freezing agent from flowing out. As a result, the snow melting effect lasts.

Because the longitudinal grooves 30 have the curve parts 32, surface areas of the side surfaces thereof increase as well as groove spaces thereof increase. This improves the heat accumulation effect, resulting in improvement of the snow accumulation prevention effect and the snow melting effect.

Subsequently, an effect of the second embodiment will be described below in comparison with a case of rivet hole rows formed by the rivets 13 (with no tracks of beam members).

Even without the tracks of the beam members, if the vibration frequency of the tamper 6 is made larger, a distance between the neighboring rivet holes 31 becomes shorter. This makes the neighboring rivet holes 31 partially overlap each other. Accordingly, rivet hole rows are formed. Such rivet hole rows have a similar pavement structure formed by the longitudinal grooves 30.

As a result of repeating test construction, in a case where there are no tracks of the beam members, shapes of longitudinal grooves largely vary and not a satisfactory drainage function is produced.

To the contrary, in the present embodiment, clearly defined longitudinal groove shapes can be formed owing to the tracks of the beam members, which provides a satisfactory drainage function.

Further, in a case where there are no tracks of the beam members, the beak parts 34 are formed to have a sharp angle at which stress is concentratively received. This raises a problem of poor durability.

To the contrary, in the present embodiment, the beak parts 34 are pressed from the sides by the tracks of the beam members. Therefore, the sharpness thereof is relaxed (see, FIG. 9), and the stress applied thereto are dispersed. As a result, durability improves.

~Remarks~

FIG. 8 and FIG. 9 illustrate examples of a case where the diameter of the rivets 13 is larger than the width of the cross section of the beam members 12. Also, there is a case where the diameter of the rivets 13 is smaller than the width of the cross section of the beam members 12.

In this case, because the longitudinal grooves 30 do not have the curve parts 32, an effect from the curve parts 32 cannot be expected. However, the following effects can be produced. Namely, insertion resistance of the beam members 12 and the following resistance are decreased largely, shifting of the beam members 12 is suppressed, and more precise construction can be performed.

Third Embodiment

Figure 10:
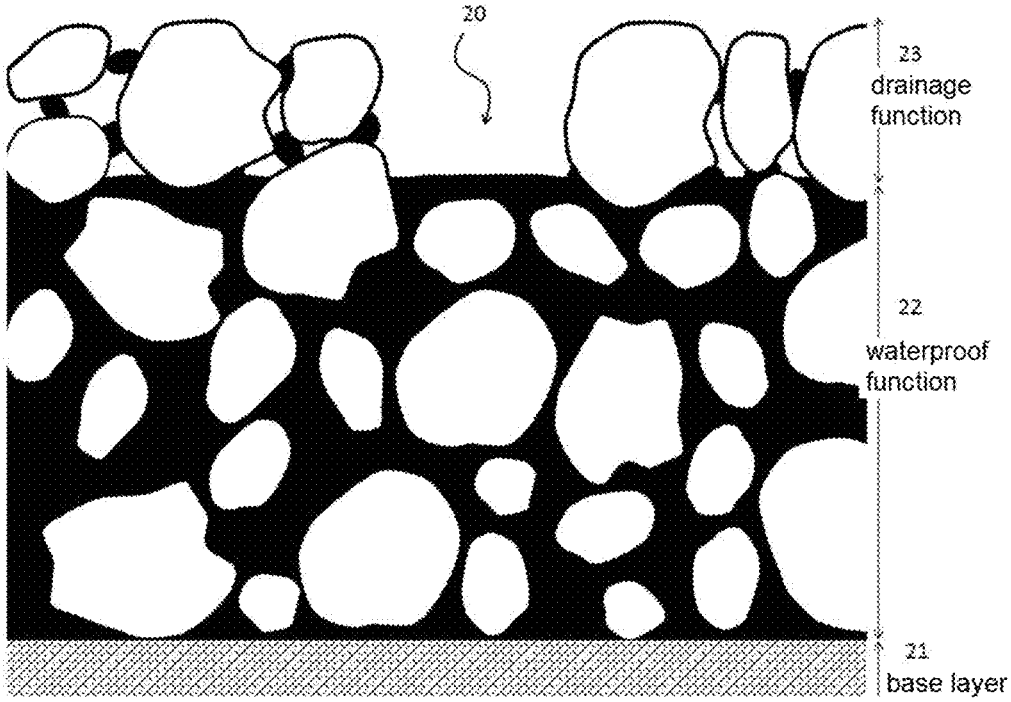
FIG. 10 illustrates a pavement structure (third embodiment).

The present invention may be applied to asphalt pavement composed of a lower layer 22 having a waterproof function and an upper layer 23 having a drainage function. FIG. 10 is a schematic block diagram illustrating the third embodiment. An application example will be described below.

Initially, an asphalt mixture is provided over the base layer 21. The asphalt mixture is composed of No. 6-sized crushed stones, No. 7-sized crushed stones, crushed sand, fine sand, stone dust, and asphalt, which are mixed together by a predetermined blending ratio. For example, a blending ratio of the No. 6-sized crushed stones is 64.5 to 72.5%, a blending ratio of the No. 7-sized crushed stones is 7.5 to 13%, a blending ratio of the crushed sand is 5 to 7%, a blending ratio of the fine sand is 5 to 7%, and a blending ratio of the stone dust is 8 to 12%. An amount of asphalt is 4 to 7% of the aggregate. A size range of the mixture is 100% when a sieve opening nominal dimension is 19 mm, 90 to 100% when a sieve opening nominal dimension is 13.2 mm, 21 to 40% when a sieve opening nominal dimension is 4.75 mm, 15.5 to 29.5% when a sieve opening nominal dimension is 2.36 mm, and 6.5 to 12.5% when a sieve opening nominal dimension is 75 μm.

Use of high-performance modification asphalt as asphalt will produce better effect. This can facilitate excellent flow property resistance and aggregate scattering resistance.

After an asphalt mixture layer is provided, a surface thereof is expanded and leveled by the asphalt finisher. A traveling condition of the asphalt finisher at the time is at a running speed of 1.5 m/min., at vibration frequency of the tamper of 1120 min.-1, and with a vibrator of 1020 cpm. Further, the asphalt mixture is subjected to rolling compaction by means of macadam roller more than 11 times and by means of 15t-tire roller more than 3 times. A temperature for performing spreading and leveling is set to a range 160 plus/minus 10° C. A primary rolling compaction temperature will be 155 plus/minus 10° C. A secondary rolling compaction temperature will be 80 plus/minus 10° C.

By compacting the asphalt mixture layer, an asphalt pavement layer having a thickness of about 40 mm is formed. Asphalt mortar is mainly charged to the lower layer 22 (having a thickness of about 30 mm) of the asphalt pavement layer. The asphalt mortar is composed of crushed sand, fine sand, stone dust, and asphalt. More specifically, as it goes lower layer, more asphalt mortar is charged in vacant space portions between aggregates. This serves to prevent permeation of water toward the base layer 21 (waterproof function).

On the other hand, a little asphalt mortar is charged to the upper layer 23 (having a thickness of about 10 mm) of the asphalt pavement layer. The asphalt contributes to the binding between aggregates. Vacant space portions, however, are left. This allows water to move relatively freely through the vacant spaces. In other words, a drainage function is relatively secured.

A preferable thickness of the upper layer is about 5 to 40% of the thickness of the asphalt pavement. In the above described example, the preferable ratio is 25% (=10 mm/40 mm).

The longitudinal grooves 20 are formed according to the thickness of the upper layer 23. A preferable depth of the longitudinal grooves 20 is equivalent to the thickness of the upper layer, however, is not necessarily precisely the same. More specifically, the depth of the longitudinal grooves 20 may reach the lower layer 22 or may be formed in partway the upper layer 23.

The asphalt pavement has both of a waterproof function and a drainage function. Further, by being provided with the longitudinal grooves 20, the drainage function remarkably improves.

Fourth Embodiment

~Summary~

The first to third embodiments are examples when the present invention is applied to the asphalt pavement. The present invention is also applicable to concrete pavement.

There is a plurality of concrete paving construction methods. A typical concrete paving construction method is a setting form construction method. The setting form construction method includes steps of setting forms and rails, spreading and leveling by a spreader, and compacting by a concrete finisher.

Recently, pavement is constructed by a slip-form construction method counting on the improvement of construction ability. In the slip-form construction method, spreading and leveling and compaction are carried out by using a slipformpaver which can self-travel owing to a crawler. Forms and rails are not needed.

For constructing short pavement, the spreading and leveling is carried out by human power, and compaction is carried out by a blitzscreed (simple finisher).

~Featured Structure and Construction~

Figure 11:
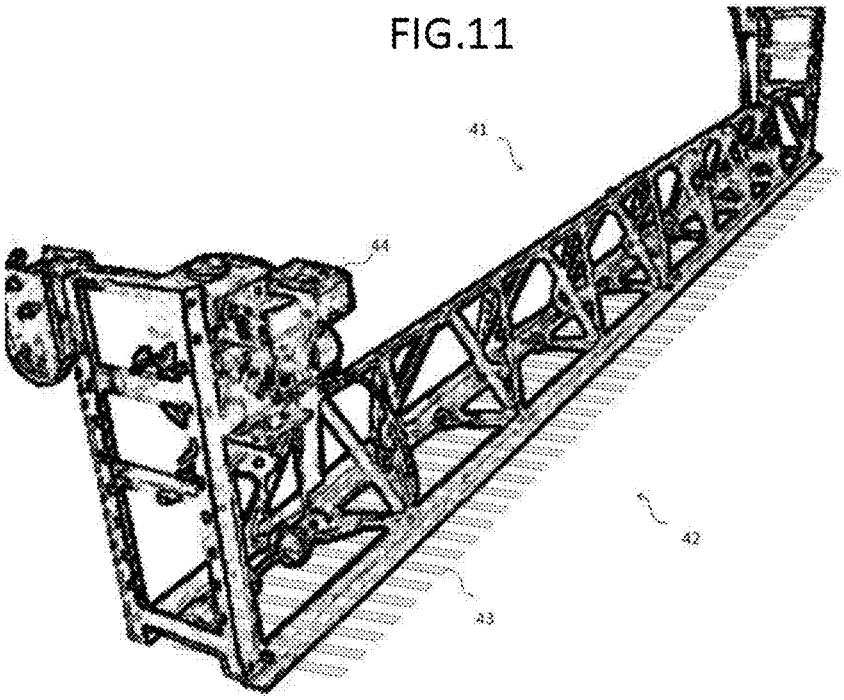
FIG. 11 illustrates a longitudinal groove forming instrument (fourth embodiment).

FIG. 11 illustrates a longitudinal groove forming instrument according to a fourth embodiment. As a featured structure of the present embodiment, a longitudinal groove forming instrument 42 is disposed on a bottom face of a blitzscreed 41.

Figure 12:
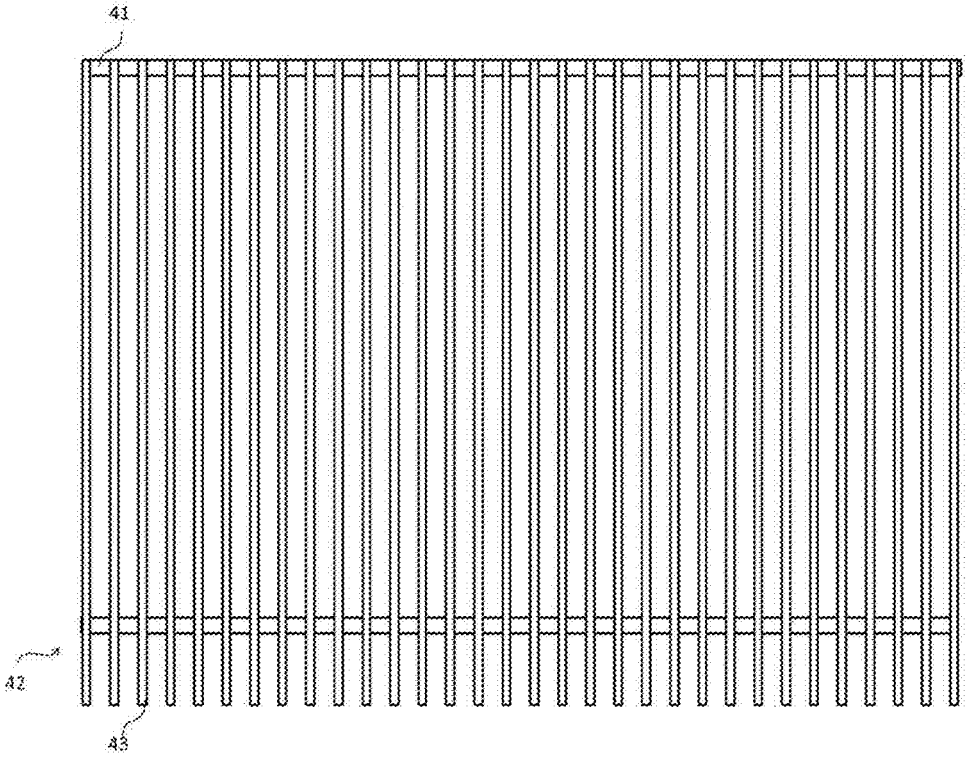
FIG. 12 illustrates the longitudinal groove forming instrument in detail.

FIG. 12 illustrates the longitudinal groove forming instrument in detail. The longitudinal groove forming instrument 42 includes a plurality of beam members 43. The beam members 43 are disposed in parallel with a direction of travel of the screed as an axis direction.

As a shape of a cross section of the beam members, an inverted triangle shape, a circular shape, a semi-circular shape, a plane shape, an inverted trapezoidal shape, etc. can be applied.

A width of the cross section of the beam members 43 is 2 mm to 40 mm, and a height of the cross section thereof is 2 mm to 40 mm. A preferable width of the cross section thereof is 5 mm to 20 mm, and a preferable height of the cross section thereof is 5 mm to 20 mm. A length of the beam members 43 is 50 to 150% of a length of a bottom face of the screed. Because concrete while casting it into a formwork has less insertion resistance than asphalt, the beam members may be longer than the beam members of the first embodiment.

The beam members 43 are disposed in such a manner that a distance between centers of the neighboring beam members 43 is 10 mm to 200 mm. Preferably, a distance between centers of the neighboring beam members 12 is 20 mm to 100 mm.

The beam members 43 may be welded on the bottom face of the blitzcreed 41 or may be mechanically joined thereto. For example, screw type beam members 43 are readily exchangeable and a cross sectional shape and a size of the beam members can be selected as required.

Figure 13:
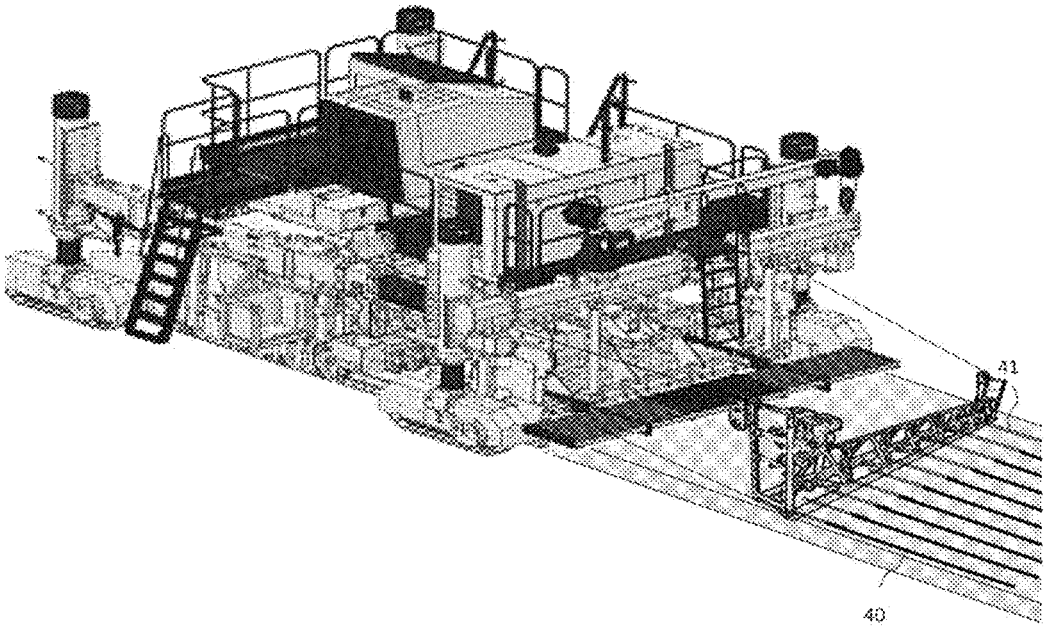
FIG. 13 schematically illustrates an operation.

FIG. 13 is a function flow chart according to the fourth embodiment. As shown in FIG. 13, the blitzscreed may be driven following the slipformpaver or may be driven following the concrete finisher.

The blitzscreed 41 is provided with a vibrator (oscillation mechanism) 44. The blitzscreed 41 is capable of self-traveling owing to the reaction force to the vibration. Therefore, the blitzscreed 41 can move independently from the slipformpaver.

In a featured operation of the present embodiment, when leveling the pavement face, the beam members 43 are pressed into the leveled face and moved in a direction of travel for leveling while the beam members are being pressed down, thereby forming the longitudinal grooves 40.

The beam members 43 are disposed on the bottom face of the blitzscreed 41. Owing to the own weight of the blitzscreed 41, the beam members 43 are pressed into the leveled face due to the pressing force from the blitzscreed 41.

As the blitzscreed 41 travels forward, the beam members 43 follows while keeping a state of being pressed into the leveled face.

The longitudinal grooves 40 are formed according to the tracks formed by the travel of the beam members 43.

Vibrations of the vibrator 44 are transferred to the beam members 43. The aggregate corresponding to the longitudinal grooves 40 is moved to both side walls of the longitudinal grooves 40.

A width of the cross section of the longitudinal grooves 40 corresponds to a width of the cross section of the beam members 43, and a depth of the longitudinal grooves 40 corresponds to a height of the cross section of the beam members 43.

A length of the longitudinal grooves 40 extends according to a travel distance of the beam members 43. A distance between centers of the neighboring longitudinal grooves 40 corresponds to a distance between centers of the neighboring beam members 43.

~Effect~

An effect of the present embodiment will be described below in comparison with the conventional art.

There is a tine grooving construction method as one of the grooving construction methods in the field of concrete pavement according to the conventional art. In the tine grooving construction method, grooves are formed on a pavement face by using a piano wire, etc. in a road crossing direction at the time of concrete paving. The tine grooving construction method is suitable for forming the transverse grooves but is not suitable for forming longitudinal grooves. Further, the method cannot produce a satisfactory drainage effect.

To the contrary, in the present embodiment, clearly defined longitudinal groove shapes can be formed by the tracks of the beam members. As a result, a satisfactory drainage function can be produced.

Fifth Embodiment

~Featured Structure and Construction~

Figure 14:
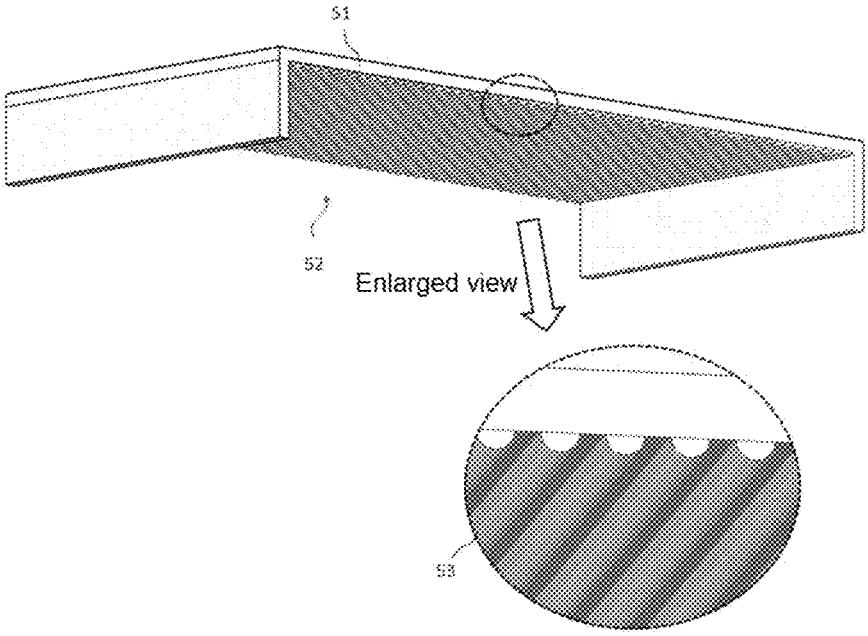
FIG. 14 illustrates a longitudinal groove forming instrument (fifth embodiment).

In the fourth embodiment, the longitudinal groove forming instrument is provided on the blitzscreed but a longitudinal groove forming instrument 52 may be disposed on a bottom face of a mold 51 of a slipformpaver. FIG. 14 illustrates a longitudinal groove forming instrument according to a fifth embodiment.

Incidentally, a mold of slipformpaver is not often referred to as screed device but has substantially an equivalent function. Therefore, it is considered, in the present application, as one embodiment of the screed device for the sake of easy description.

The longitudinal groove forming instrument 52 includes a plurality of beam members 53. The beam members 53 are disposed in parallel with a direction of travel of the slipformpaver as an axial direction.

As the cross sectional shape of the beam members, an inverted triangle shape, a circular shape, a semi-circular shape, a plane shape, an inverted trapezoidal shape, etc. can be applied. In FIG. 14, a semi-circular shape is exemplified.

A width of the cross section of the beam members 53 is 2 mm to 40 mm, and a height of the cross section thereof is 2 mm to 40 mm. A preferable width of the cross section thereof is 5 mm to 20 mm, and a preferable height of the cross section thereof is 5 mm to 20 mm. A length of the beam members 53 is 50 to 150% of a length of the bottom face of the mold. Concrete has less insertion resistance than asphalt. Therefore, the beam members may be longer than the beam members of the first embodiment.

The beam members 53 are disposed in such a manner that a distance between centers of the neighboring beam members 53 is 10 mm to 200 mm. More preferably, a distance between centers of the neighboring beam members 53 is 20 mm to 100 mm.

The beam members 53 may be welded on the bottom face of the mold 51 or may be mechanically joined thereto. For example, screw type beam members are readily exchangeable and a cross sectional shape and a size of the beam members can be selected as required.

In a featured operation of the present embodiment, when the slipformpaver levels a pavement face, the beam members 53 are pressed into the leveled face and moved in a direction of travel for leveling while the beam members 53 are being pressed down, thereby forming the longitudinal grooves 50.

The beam members 53 are disposed on the bottom face of the mold 51. Simultaneously with the formation of a leveled face by the mold 51, the beam members 53 are pressed into the leveled face owing to the pressing force.

As the slipformpaver travels forward, the beam members 53 move while keeping a state of being pressed into the leveled face.

The longitudinal grooves 50 (not shown) are formed according to the tracks formed by the travel of the beam members 53.

The slipformpaver has a vibration function. The vibration thereof is transferred to the beam members 53, and the aggregate corresponding to the longitudinal grooves 50 is moved to both walls of the longitudinal grooves 50.

A width of the cross section of the longitudinal grooves 50 corresponds to the width of the cross section of the beam members 53, and a depth of the longitudinal grooves 50 corresponds to the height of the cross section of the beam members 53.

A length of the longitudinal grooves 50 extends according to a travel distance of the beam members 53. A distance between centers of the neighboring longitudinal grooves 50 corresponds to the distance between centers of the neighboring beam members 53.

~Effect~

The fifth embodiment produces an effect almost equivalent to the effect of the fourth embodiment.

When longitudinal grooves are formed by the slip-form construction method, longitudinal grooves can be formed without using a blitzscreed.

Sixth Embodiment

The fourth embodiment may be combined with the fifth embodiment. In this case, it is important to dispose the beam members 43 of the fourth embodiment at positions corresponding to positions of the beam members 53 of the fifth embodiment.

A construction operation will be described with reference to FIG. 13. The blitzscreed is driven following the slipformpaver.

Initially, the longitudinal grooves 50 are formed by the longitudinal groove forming instrument 52 (see, FIG. 14), which travels ahead. Then, the longitudinal grooves 40 are formed by the longitudinal groove forming instrument 42 (see, FIG. 11), which travels following the longitudinal groove forming instrument 52.

The longitudinal grooves 40 are formed at positions corresponding to the longitudinal grooves 50. This ensures formation of clearly defined longitudinal groove shapes.

REFERENCE CHARACTER LIST

1 crawler
2 driver's seat
3 hopper
4 bar feeder
5 screw spreader
6 tamper
7 main screed
8 expansion screed
9 vibrator
11 longitudinal groove forming instrument
12 beam member
13 rivet
14 beam member end
20 longitudinal groove
21 base layer
22 lower layer
23 upper layer
30 longitudinal groove
31 rivet hole
32 curve part
33 straight part
34 beak shape
40 longitudinal groove
41 blitzscreed
42 longitudinal groove forming instrument
43 beam member
44 vibrator
50 longitudinal groove
51 mold
52 longitudinal groove forming instrument
53 beam member

The invention claimed is:

1. A paving construction method using a longitudinal groove forming instrument for pavement that is disposed on a bottom face of a screed device and comprises a plurality of beam members disposed in parallel with a direction of travel of the screed device as an axis direction:

wherein the pavement is asphalt pavement; and wherein the screed device is provided on an asphalt finisher;

wherein the asphalt finisher comprises a tamper device;

wherein protruding members disposed on a bottom face of the tamper device are pressed into the leveled face to form concave portions; and wherein the beam members are pressed into the leveled face at positions corresponding to positions of the concave portions;

wherein longitudinal grooves are formed in such a manner that, when leveling a pavement face by the screed device, the beam members are pressed into the leveled face owing to a self-weight of the screed device, and, while the beam members are being pressed into the leveled face, the beam members are moved following the screed device in a direction of travel of the screed device.

2. The paving construction method according to claim 1:

wherein the screed device has a vibration function; and wherein vibration thereof is applied to the pavement face while leveling the pavement face by the screed device.

3. The paving construction method according to claim 1:

forming a waterproof region in a lower layer of the asphalt pavement; and forming a drainage region on a top surface of the asphalt pavement;

wherein the asphalt pavement comprises the lower layer having a waterproof function and an upper layer having a drainage function; and wherein the longitudinal grooves are formed on the upper layer.

4. A paving construction method using a longitudinal groove forming instrument for pavement that is disposed on a bottom face of a screed device and comprises a plurality of beam members disposed in parallel with a direction of travel of the screed device as an axis direction:

wherein the pavement is concrete pavement; and wherein the screed device is a blitzscreed; and wherein longitudinal grooves are formed in such a manner that, when leveling a pavement face by the screed device, the beam members are pressed into the leveled face owing to a self-weight of the screed device, and, while the beam members are being pressed into the leveled face, the beam members are moved following the screed device in a direction of travel of the screed device;

wherein the longitudinal grooves have curved parts of a rivet shape formed repetitively in a road longitudinal direction, wherein the longitudinal grooves are formed according to tracks of the beam members at an approximately constant depth.

5. A pavement structure comprising:

longitudinal grooves having curve parts of a rivet shape formed repetitively in a road longitudinal direction, wherein the longitudinal grooves are formed according to tracks of beam members at an approximately constant depth.

6. A paving construction method using a longitudinal groove forming instrument for pavement that is disposed on a bottom face of a screed device and comprises a plurality of beam members disposed in parallel with a direction of travel of the screed device as an axis direction:

wherein longitudinal grooves are formed in such a manner that, when leveling a pavement face by the screed device, the beam members are pressed into the leveled face owing to a self-weight of the screed device, and, while the beam members are being pressed into the leveled face, the beam members are moved following the screed device in a direction of travel of the screed device; and wherein the screed device has a vibration function; and wherein vibration thereof is applied to the pavement face while leveling the pavement face by the screed device;

wherein the longitudinal grooves have curved parts of a rivet shape formed repetitively in a road longitudinal direction, wherein the longitudinal grooves are formed according to tracks of the beam members at an approximately constant depth.

* * * * *